United States Patent [19]

Cernansky et al.

[11] 4,342,175

[45] Aug. 3, 1982

[54] RADIO CONTROLLED MOTORCYCLE

[75] Inventors: Joseph S. Cernansky, Manhattan Beach; Harold E. Garner, Lawndale, both of Calif.

[73] Assignee: Entex Industries, Inc., Compton, Calif.

[21] Appl. No.: 170,631

[22] Filed: Jul. 21, 1980

[51] Int. Cl.[3] ..... A63H 30/04; A63H 17/36; A63H 17/26

[52] U.S. Cl. ..... 46/254; 46/221; 46/262; 180/167; 280/276; 280/279

[58] Field of Search ..... 46/210, 213, 221, 253, 46/254, 255, 256, 262, 167, 169 B, 135 R; 180/167, 219, 220, 223, 227; 280/92, 276, 279, 280

[56] References Cited

U.S. PATENT DOCUMENTS

| | | | |
|---|---|---|---|
| 1,975,305 | 10/1934 | Wilder | 46/15 |
| 3,303,821 | 2/1967 | Harris | 46/254 X |
| 3,404,483 | 10/1968 | Gardel et al. | 46/135 R |
| 3,546,814 | 12/1970 | Melendey | 46/254 |
| 3,708,913 | 1/1973 | Terzian et al. | 46/202 X |
| 3,785,086 | 1/1974 | Escobedo | 46/213 |
| 3,812,929 | 5/1974 | Farque | 180/167 |
| 3,826,038 | 7/1974 | Gentilini | 46/202 X |
| 4,267,663 | 5/1981 | Nagahara | 46/254 |

FOREIGN PATENT DOCUMENTS

| | | | |
|---|---|---|---|
| 1098676 | 3/1955 | France | 46/213 |
| 1265135 | 5/1961 | France | 46/221 |
| 609962 | 10/1960 | Italy | 46/202 |
| 260886 | 4/1949 | Switzerland | 46/201 |
| 6767 | of 1884 | United Kingdom | 280/276 |
| 167622 | 8/1921 | United Kingdom | 280/276 |
| 811783 | 4/1959 | United Kingdom | 180/220 |

*Primary Examiner*—F. Barry Shay
*Attorney, Agent, or Firm*—Don B. Finkelstein

[57] ABSTRACT

A two-wheeled motorcycle having a frame carrying a drive motor, a radio, a servo mechanism controlled by the radio, and a power source for driving the motor, radio, and servo. The servo mechanism includes a weight which may be moved to one side or the other of a generally vertical plane extending through the motorcycle when it is in an upright position. The steering crown is arranged so that a plane including the axes of the down tube and the fork is behind the main pivot. The axle of the front wheel is in the plane of the fork axes. The plane including these axes intersects the surface upon which the motorcycle rests at an angle in the range of about 20°–25° relative to vertical. The arrangement of the steering crown is such that, when the servo moves the weight to one side of the generally vertical plane, the front wheel will tend to turn into the direction in which the weight is moved. This is accomplished by insuring that the plane including the axes of the down tubes and forks is behind, but parallel to, the pivot axis of the crown, relative to the frame.

26 Claims, 6 Drawing Figures

FIG. 1
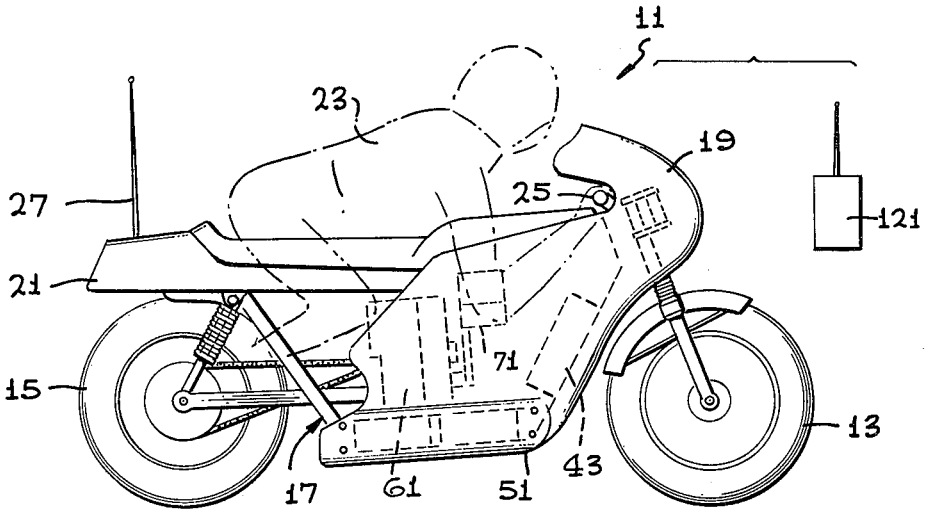
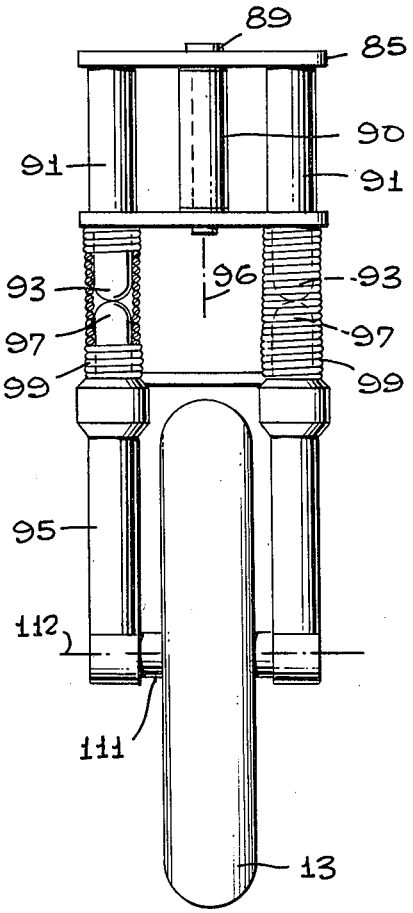
FIG. 4
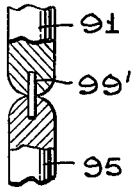
FIG. 6
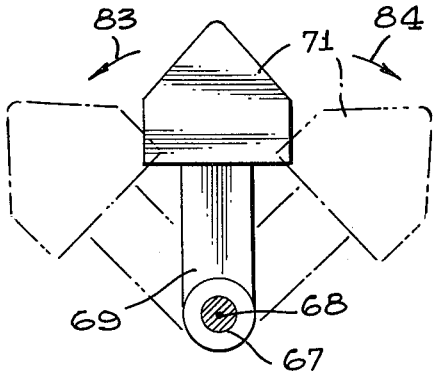
FIG. 5

RADIO CONTROLLED MOTORCYCLE

BACKGROUND OF THE INVENTION

The present invention relates to a two-wheeled motorcycle, or motorized bicycle, and, more particularly, to apparatus for steering the bicycle. Even more specifically, the invention relates to an apparatus for remotely controlling such a vehicle.

The present invention has particular application with respect to toy motorcycles which are to be directed through turns by remote control, such as by a radio system.

In the past, a wide variety of toy motorcycles have been devised which can be operated in such a manner as to control a movement of the toy. In many cases, the toys were controlled by a tether such as is shown, for example, in U.S. Pat. Nos. 2,699,011; 3,708,913; 3,826,038; and 3,984,105. Since such toys must be attached to a tether to provide suitable control, the ability of the user to observe the toy while it moves is quite limited. While such toys may produce some exercise for the user, they are relatively unsatisfactory from the standpoint of requiring imagination since their movements are limited either by a central pivot for the tether or by the actions of the user who pulls the tether.

Other prior art toys of this general character have allowed remote control via radio or similar means. Such toys are shown, for example, in U.S. Pat. Nos. 3,708,913; 3,751,851; and 3,826,038. In such cases, however, the inventors foresaw the likelihood that their toys would tend to tip over during use. As a result, they usually provided a relatively low center of gravity, as well as auxiliary wheels, imitation foot rests, unusually shaped main wheels, etc., in an attempt to prevent the toy from tipping over. For each such device that the prior art employs, however, the resulting toys appear less and less like the actual machines which were meant to be imitated by the designers.

As a result, children using the toys either do not care for their appearance or else grow tired of them as a result of normal short attention spans, aggravated by the requirement for very little imagination.

Several of the prior art toys also require very complex systems for steering the motorcycles, such as those depicted in U.S. Pat. Nos. 3,546,814 and 3,751,851.

As a result, the prior art toys have been substantially unsuccessful since the people playing with them quickly became bored, the toys themselves were too expensive, or the mechanisms were so complex that they quickly became damaged and/or operated erratically.

In spite of all of the failures of the prior art toys, there still exists a need for a toy which is relatively inexpensive, realistic in appearance and operation, and simple and rugged enough in its construction so that it can be properly operated for a long time. Up until this time, such a toy has not been available.

SUMMARY OF THE INVENTION

The present invention relates to a motorcycle which can be remotely steered, such as by radio control, and which obviates the problems of the prior art. In other words, the invention may be embodied in very simple, inexpensive structure which, nevertheless, is sufficiently rugged to withstand the severe punishment normally imposed upon toys. Further, the invention may be employed in any size motorcycle; even one which might be large enough to be a "drone" for experimental purposes.

For the sake of convenience, as utilized herein, a plane which includes the axes of the down tubes, fork, and front wheel axle when the front wheel is aligned with the frame for straight-ahead-travel will be referred to as the "steering plane."

The invention takes into account the fact that, when the pivot axis of the steering crown is in, or behind, the steering plane, the bicycle has a natural tendency to fall over when the center of gravity of the bicycle is shifted to one side. Considering, for example, the case when a bike is upright, it can be presumed that a substantially vertical plane extends longitudinally through the bike from front to rear, with the center of gravity of the bike in that plane. If the center of gravity shifts to one side of the longitudinal plane, the steering mechanism will tend to turn the front wheel toward the opposite side of the plane. For example, if the center of gravity of the bike and its rider, cargo, etc., shifts toward the left of the longitudinal plane, the front wheel will tend to turn toward the right. When this occurs, the bike tends to tip over in the direction toward which the center of gravity has shifted.

While this is also true in the case of full scale motorcycles and bicycles, the tendency for the vehicle to fall is overcome by the rider exerting a force against the tendency of the front wheel to turn away from the direction of movement of the center of gravity.

In toys, of course, this same tendency can be overcome by providing a mechanism which exerts a predetermined force for the same purpose.

In the present invention, on the other hand, the relationship of the structure is such that, when the center of gravity of the bicycle is shifted to one side of the longitudinal plane, the steering mechanism will tend to turn the front wheel in that same direction. This not only helps to prevent the vehicle from falling over, but also positively turns the vehicle in response to the amount of shift of the center of gravity.

This can be accomplished, for example, by providing a steering crown having a pivot axis which is forward of the steering plane. Preferably, the crown pivot axis is parallel to the steering plane. In practice, it has been found to be preferable that the angle at which the steering plane intersects the surface upon which the front wheel rests is between 20° and 25° relative to vertical when the front wheel is aligned with the longitudinal plane. It has been found, for example, that 22° is the optimum angle.

When the present invention is to be employed in a toy or a "drone," it may also employ a weight which may be shifted to one side of the longitudinal plane, described previously, by remote control. In the presently preferred embodiment, the weight may be operatively connected to a servo which may turn a pivot rod in either direction under radio control. With the steering weight connected to the pivot rod, the movement of the center of gravity will be dependent upon the amount that the steering weight is shifted out of the longitudinal plane.

As will now be readily realized, the present invention may be very simply constructed to employ a shiftable steering weight which may be included within a structural combination which causes the front or steering wheel to turn in the same direction, relative to the longitudinal plane, toward which the center of gravity is shifted. Consequently, the structure can be relatively simple while, at the same time, being very rugged, reliable, and inexpensive.

Upon review of the following Detailed Description, taken together with the accompanying drawings, those skilled in the art will realize that the present invention may be employed in a wide variety of embodiments, many of which may not even resemble that described and depicted here. Nevertheless, it should be borne in mind that the description and accompanying drawings are merely illustrative of the principles of the present invention and only set forth the best mode presently known for accomplishing the invention. They are not intended to delimit or restrict the scope of the invention which is defined and limited only by the appended claims.

BRIEF DESCRIPTION OF THE DRAWINGS

FIG. 1 comprises a general side elevation of a vehicle employing a preferred embodiment of the present invention;

FIG. 4 comprises a front elevation of the vehicle shown in FIG. 2, as seen along a line IV—IV in FIG. 2;

FIG. 5 comprises a partial elevation view, illustrating the movement of the steering weight, as seen along a line V—V of FIG. 2; and FIG. 6 comprises an enlarged, partial view, of an alternate embodiment of structure which may be employed to connect the down tube to the fork in the front steering mechanism.

DETAILED DESCRIPTION

Figure 3:
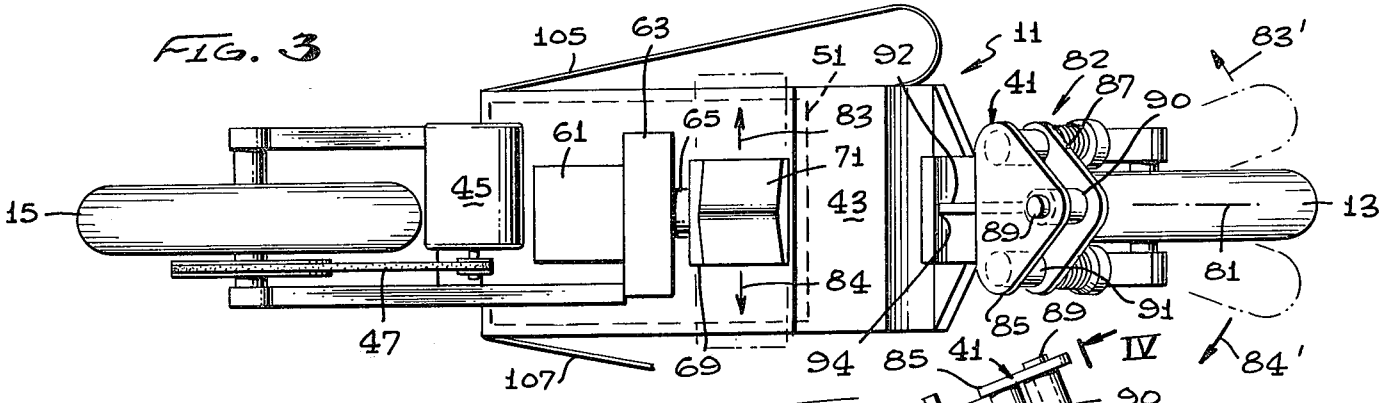
FIG. 3 comprises a top plan view of the vehicle depicted in FIG. 2.

The presently preferred embodiment of this invention is depicted as vehicle 11 shown generally in FIG. 1, which may comprise a toy or remotely controlled device of any desired size. As illustrated, the vehicle includes a front wheel 13, a rear wheel 15, a frame generally illustrated at 17, a wind fairing 19, and a seat 21. If desired, a rider 23 may be mounted on the seat so that his hands are resting upon a handle bar 25 in the normal manner. Of course, if the vehicle is a toy, it will be realized that the rider 23 may be a doll which is fixed to the seat and handle bars in any desired manner.

Also as illustrated in the drawing, an antenna 27 may be provided for receiving radio signals.

Figure 2:
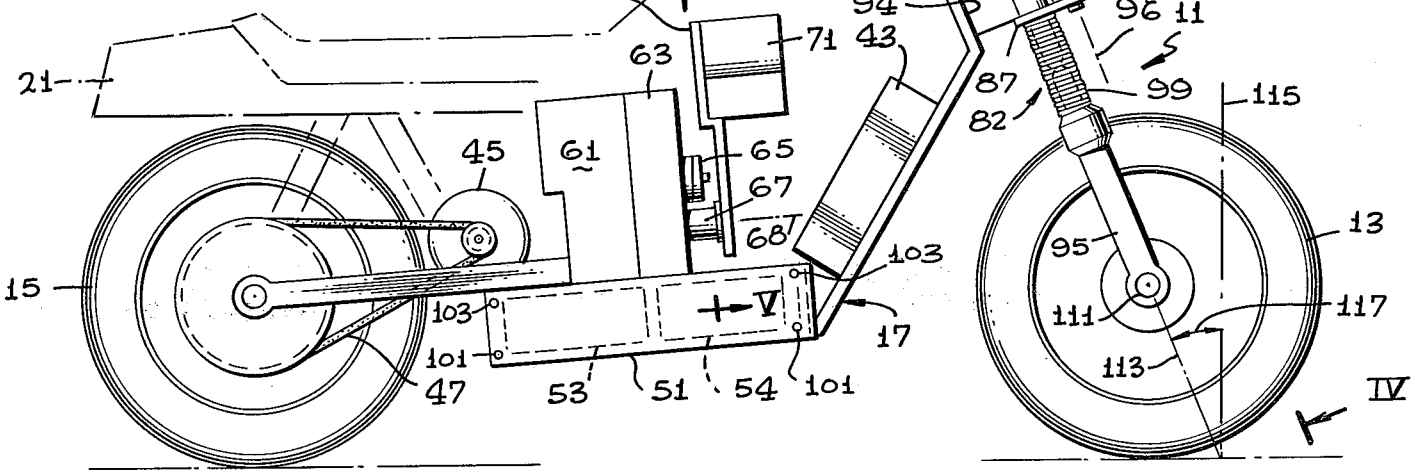
FIG. 2 comprises an enlarged side view of the vehicle shown in FIG. 1, with various portions eliminated for the sake of clarity.

Turning now to FIGS. 2 and 3, it can be seen that the frame 17 is produced so as to extend between a steering crown 41 and the axle of rear wheel 15. A receiver 43 may be mounted on the frame in any suitable manner for cooperation with the antenna 27 for receiving signals in order to produce a useful response in a well known manner. As shown, a motor 45 may be mounted on the frame in such a manner as to drive the wheel 15 by any suitable means, such as a chain belt, or direct drive system 47.

If desired, a battery compartment 51 may be provided so as to house a battery 53 which may be employed to power the motor 45. Similarly, the compartment 51 may house one or more batteries 54 to power the receiver 43.

An intermediate portion of the frame 17 may be enlarged as illustrated in FIG. 3 in the vicinity of the battery compartment 51 in order to provide a suitable mounting space for a servo motor 61 which may be of any well known type. The servo 61 may be connected to a gear train (not shown) within a housing 63 for cooperation with a clutch 65. In this preferred embodiment, an output shaft 67 may extend from the housing 63 and an arm 69 of any desired size and shape may be fixed to the shaft. At the opposite end of the arm, a turning mass or steering weight 71 may be fixed for pivotal movement with the arm when the latter is rotated about the axis of the shaft 67 by actuation of the servo 61. The weight 71 and arm 69 form a steering mass which may be used to exert a torque on the frame 17 to turn the vehicle. The weight is free-swinging, i.e., it is attached to the vehicle only by arm 69, and resembles an inverted pendulum. As will be seen presently, shifting of the weight to one side or the other of the frame will exert a torque which has a tendency to tip the vehicle over toward the side to which the mass is moved. Rather than tip over, however, the specific relationship of the steering mechanism (to be discussed below) will cause the front wheel to turn and steer the bike toward that same side.

The receiver 43 and servo motor 61 may be, for example, of the conventional type of R/C systems long utilized in various models and other devices for remote control thereof. The receiver 43 receives signals from a transmitter 121 (FIG. 1) and causes actuation of the servo motor 61 in response thereto to cause rotation of the shaft 67. Rotation of the shaft 67 rotates the arm 69 and weight 71 about the axis 68 (FIG. 2).

In this embodiment of the invention, it has been found to be desirable to utilize the clutch 65 between the servo 61 and the arm 69 in order to protect the servo. When the receiver 43 is turned off, for example, by a switch (not shown) or removal of the batteries 54, the clutch 65 will slip if the weight 71 is moved to one side or the other due to the application of an external force. The clutch will prevent this movement from being transmitted back through the gear train 63 into the servo. As a result, servo 61 will not be damaged when this occurs. The specific structure of the clutch is not critical to an understanding of this invention, and those skilled in the art will be readily aware that clutches which produce the desired result are readily commercially available.

Referring now to FIG. 3, the motorcycle is shown substantially upright, in a straight-ahead-travel condition. As such, a generally vertical, longitudinal plane, depicted by the phantom line 81, may be considered to pass through the longitudinal center line of the vehicle in such a way that all of the weight or mass of the vehicle, including the motorcycle, the doll 23, etc., is symmetrically located relative to the longitudinal plane. In other words, the center of gravity of the bike is on the longitudinal plane 81. Consequently, the steering weight 71 will shift the center of gravity to one side or the other of plane 81 as it is moved by the arm 69 as shown by the arrows 83 and 84.

In prior art devices of this nature, the general arrangement of the front steering wheel of the bicycle was such that, upon shifting of the center of gravity to one side or the other of the longitudinal plane, the steering wheel would turn in the opposite direction. Thus, if the steering weight, and the center of gravity, shifted to the left side of the plane 81, the steering wheel would turn to the right, and vice versa.

In this embodiment of the present invention, on the other hand, mounting a means, generally designated 82, is provided for mounting the front wheel 13, which is the steering wheel, to the frame 17. The mounting means 82 generally comprises the steering crown 41 which has a top plate 85 and a bottom plate 87. These two plates may be fixedly coupled together by a pivot pin 89 which is always within the longitudinal plane 81. The pivot pin 89 is concentrically enclosed, preferably with a light frictional engagement, within a pivot tube 90 which abuts but is not fixed to either plate 85 or 87. The pivot tube 90 is fixedly coupled to frame 17 by attachment plate 92 as shown at 94. Thus, the steering crown 41 rotates about the axis 96 of pivot pin 89 as pivot pin 89 rotates, in a manner similar to a sleeve bearing, within fixed pivot tube 90.

Referring particularly to FIG. 4, it can be seen that a pair of down tubes 91 may be fixed between the plates 85 and 87 so as to extend below the plates to terminate at rounded ends 93. The axes of the down tubes 91 may be considered to be located in a common plane, that is, the steering plane 113 (FIG. 2), which is parallel to the axis 96 of the pivot pin 89. The steering plane 113, as previously defined, is preferably located behind the pivot axis 96 of the pin 89, as illustrated in FIG. 2. The pivot axis 96, considered in its extension to the surface supporting the motorcycle wheels, intersects the supporting surface at an acute angle, for reasons which will become apparent presently.

Referring again to FIG. 4, it can be seen that a fork 95 may be provided with a pair of rods having upper rounded or hemispherical ends 97 which are preferably located in abutment with the lower ends 93 of the down tubes 91. The lower ends of the down tubes and the upper ends of the fork may be held together by suitable springs 99 having internal diameters which are preferably so sized that the ends of the tubes and fork are tightly gripped by the springs to hold the rounded ends in abutment. Thus, under normal conditions, spring 99 will maintain the axes of the fork shafts and the down tubes in coaxial relationships and in the steering plane.

Front wheel 13 may be rotatably mounted on an axle 111 fixed between the opposite shafts on the fork 95, as illustrated in FIG. 4. Thus, preferably, the axis 112 of the axle 111 is in the same plane as the axes of the down tubes and the fork, i.e, the steering plane 113.

Referring again to FIG. 2, it can be seen that the steering plane 113 may be considered to intersect a generally vertical reference plane 115 at the surface upon which the motorcycle is standing. In practice, it has been found that an angle 117 between the intersecting planes during normal conditions is preferably 20°–25°, with the optimum angle being approximately 22°.

Due to the relationship of pivot axis 96 and the steering plane 113, as described, when the steering weight or mass 71 is shifted to one side or the other of the longitudinal plane 81, the wheel 13 will tend to turn into the direction toward which the weight has been moved, as shown in phantom in FIG. 3. Thus, front wheel 13 will turn in the direction indicated by arrow 83' when weight 71 moves in the direction indicated by arrow 83; the wheel will turn in the direction indicated by the arrow 84' when the weight 71 moves in the direction indicated by the arrow 84. This turning of the steering wheel 13 is achieved by the relationship of the pivot axis 96 relative to the steering plane 113 and the selection of the angle 117.

It will be realized by those skilled in the art that the fork 95 may be fastened to the down tubes 91 in any suitable manner. On the other hand, the rounded, abutting end-spring combination is relatively simple and inexpensive and allows some shock absorption.

If, while the motorcycle is moving, the front wheel 113 encounters an obstruction or a bump in the surface along which it is traveling, the relationship of the hemispherical ends 93 and 97 of the down tubes 91 and fork 95 will allow some give in the movement of the wheel. The give, however, will be controlled by the tension in the spring 99 which will cause the fork to return to the normal position in a rapid manner.

As a result, a person playing with the toy will be able to drive it into an obstruction, such as furniture, a stair riser, etc., and the vehicle will be rugged enough to withstand such punishment without damage. The user of the toy may generate a radio signal from a transmitter, such as shown at 121 in FIG. 1, causing the signal to be directed to the receiver 43 via the antenna 27. Upon receipt of the signal, the servo 61 will be actuated through the gear train 63 and the clutch 65 so as to move the weight 71 to one side or the other of the longitudinal plane 81. As a result of the shifting of the center of gravity caused by movement of the steering weight 71, the motorcycle will tend to tip in that direction. The relationship of the crown 41 and the steering plane 113 will cause the front wheel 13 to turn in the same direction into which the weight is shifted, thus preventing the bike from tipping over. When the turn has been accomplished, the operator can again actuate the transmitter 121, causing the steering weight 71 to return to the position in which it is centered on the longitudinal axis 81, thus causing the steering wheel 13 to return to the straight-ahead position.

Those skilled in the art will realize that the steering weight may be substantially hidden from view by the body of the "rider" 23 and the fairing 19. This of course, will enhance the appearance of the toy and make it look more realistic. Of course, many such techniques may be employed to modify and enhance structures employing the invention.

Referring again to FIGS. 2 and 3 specifically, it can be seen that a set of lower apertures 101 and a set of upper apertures 103 may be provided near the ends of the battery case 51. Preferably, similar sets of apertures may be provided in both sides of the battery case.

A crash bar 105 may be located in the apertures on one side of the bicycle and a similar crash bar 107 may be positioned in one of the sets of apertures on the other side. The crash bars will help a person using the toy to maintain the toy in an upright position during use. For example, when a person is first learning to remotely control the motorcycle, the crash bars 105 and 107 can be positioned in the apertures 101 on each side of the motorcycle. The crash bars will, in actuality, aid in maintaining the motorcycle in an upright position when it makes a turn or comes to a stop. As the operator acquires more skill, the crash bars can be repositioned into the apertures 103 since there will be fewer times that the motorcycle will tend to fall over during its use. Finally as the operator becomes thoroughly skilled, i.e., he can put the motorcycle through turns without causing it to fall over and can direct it to return to him so that he can pick it up just as it stops, the crash bars can be removed altogether.

Thus, as the skill of the user of the toy improves, his interest will be maintained since the number of times that the toy will fall over and require the operator to reposition it will be minimized. At the same time, the toy will provide a challenge to the operator to both maintain and improve his control skills. The progression of the operator's skills can therefore occur with minimum damage to the toy. At the same time, a beginner will be able to pick up and use the toy without experiencing the frustrations which would arise without the presence of the crash bars. The crash bars will prevent the motorcycle from falling over to one side the or other when it stops, until such time as the operator is so skilled that he can bring the motorcycle back to himself and pick it up by hand just as it comes to a full stop.

Of course, many of the preferred embodiment elements described and depicted here are susceptible to design changes without departure from the spirit of the invention. For example, as shown in FIG. 6, each down tube 91 may be attached to the adjacent end of fork section 95 by means of a spring or flexible rod 99' which may be embedded and/or bonded in apertures of the down tube and fork as shown. Thus, the same type of flexibility can be provided in the steering mechanism with difference structure. Similar design alterations which utilize the invention taught here will now be readily apparent to those skilled in the art.

Having now reviewed this Detailed Description and the drawings of the presently preferred embodiment, those skilled in the art will realize that these merely define a presently preferred embodiment of the invention instead of delimitating it. Rather, it must be kept in mind that the scope of the invention, as set forth in the following claims, is broad enough to encompass a substantial number and wide variety of embodiments, many of which may not even resemble that depicted and described here. Nevertheless, such additional embodiments will employ the spirit and scope of the invention which is established only by the following claims.

We claim:

1. In a motorcycle including a longitudinal frame, a front and rear wheel mounted on the frame, a motor mounted on the frame in driving relationship to the rear wheel, and means for controlling the movement of the front wheel relative to the frame comprising:

pivot means fixed to the frame and providing a first axis, the extension of which intersects the surface upon which the motorcycle is supported, when the latter is upright, at an acute angle;

means for supporting the front wheel so that, when the front wheel is aligned with the longitudinal frame, the axis of rotation thereof is perpendicular to, but does not intersect, the first axis and is normally behind the first axis, relative to the longitudinal frame at the location in which an extension of the first axis and the axis of rotation of the front wheel are closest to one another;

fork means to which the front wheel is rotatably attached;

down tube means fixed to the pivot means; and means for flexibly connecting the fork means and the down tube means to one another such that the axes thereof are perpendicular to and intersect the axis of rotation of the front wheel and are parallel to and do not intersect the first axis, comprising hemispherical ends on the fork means and down tube means, and means to maintain the hemispherical ends in close abutment and, normally, the down tube means and the fork means in coaxial alignment.

2. The motorcycle of claim 1 wherein, when the motorcycle is upright and the front wheel is aligned with the frame, the coaxial axes of the fork means and down tube means intersect the surface upon which the motorcycle rests at an angle of about 20° to 25°, relative to vertical.

3. The motorcycle of claim 1 wherein, when the motorcycle is upright and the front wheel is aligned with the frame, the coaxial axes of the fork means and down tube means intersect the surface upon which the motorcycle rests at an angle of about 22° to 25°, relative to vertical.

4. The motorcycle of claim 1, 2, or 3 including means selectively positionable on and removable from the frame for aiding the user of the motorcycle to prevent the motorcycle from tipping over during use.

5. A two-wheeled, radio-controlled vehicle comprising:

a longitudinal frame;

a rear wheel rotatably mounted near one end of the frame;

a motor mounted on the frame;

drive means connecting the rear wheel to the motor for moving the vehicle;

servo motor means mounted on the frame at a low position thereon to aid in creating a low center of gravity for the vehicle;

steering weight means operatively connected to the servo motor means for remote control thereof upon receipt of a predetermined signal; said steering weight means comprising an arm operatively connected near one end thereof to the servo motor means for pivotal movement about a pivot axis of the servo motor means, and a turning mass located on the other end of the arm, the arm and mass forming an inverted pendulum-like means which may be pivoted by the servo motor means between predetermined limits on each side of the longitudinal frame;

pivot means mounted near the front end of the frame for supporting a steering crown for pivotal movement about a pivot axis;

a steering crown fixedly attached to the pivot means and including down tube means suspended from the crown and having a pair of parallel axes;

fork means movably fastened to the down tube means and having a pair of parallel axes which are usually coaxial with the down tube means axes, the fork means supporting a front wheel for rotation about an axle which is fixed to the fork means; and means, fixing the down tube means to the fork means, for allowing limited relative movement therebetween so that an axes of the fork means and the down tube axes are temporarily non-coaxially aligned when the front wheel contacts an obstruction during movement of the vehicle.

6. The vehicle of claim 5 wherein the axis of the pivot means is forward of the down tube means axes when the front wheel is generally aligned with the frame in the upright position of the vehicle.

7. The vehicle of claim 5 wherein the down tube means comprises a pair of aligned members, each having an axis which is substantially parallel to the axis of the pivot means; and the pivot means axis is on the opposite side of the down tube means from the steering weight means.

8. The vehicle of claim 6 or 7 wherein the axis of the pivot means is so related to the down tube means axes that the front wheel has a tendency to turn in the direction in which the vehicle leans when the steering weight means is pivoted to one side of the longitudinal frame by the servo means.

9. The vehicle of 5, 6, 7, or 8 wherein the down tube means axes intersect the surface supporting the vehicle at an angle of approximately 20° to 25° relative to vertical when the front wheel is aligned with the longitudinal frame and the latter is substantially upright.

10. The vehicle of claim 5, 6, 7, or 8 wherein the down tube means axes intersect the surface supporting the vehicle at an angle of approximately 22° to 25° relative to vertical when the front wheel is aligned with the longitudinal frame and the latter is substantially upright.

11. A two-wheeled vehicle having front and back wheels and a frame to which the wheels are rotatably attached, the weight of the wheels and frame of the vehicle being normally symmetrical relative to a generally vertical plane extending centrally and longitudinally therethrough when the vehicle is upright so that the center of gravity of the vehicle is in the longitudinal plane, and further comprising:

means for moving the vehicle center of gravity to one side of the longitudinal plane, comprising weight means normally symmetrically aligned with the longitudinal plane of the at a position above the center of gravity of the vehicle, means for pivoting the weight means between positions to either side of the longitudinal plane, the pivoting means being located below the weight means and the weight means being unattached to the vehicle except for its connection to the pivoting means, thus causing the weight means to shift the center of gravity of the vehicle to one side of the longitudinal plane when the pivoting means is actuated and to return the center of gravity to its normal position in the longitudinal plane when the pivoting means is reactuated, and means for selectively actuating the pivoting means; and means for mounting the front wheel to the vehicle comprising first means forming a pivot axis and second means for supporting the front wheel for pivotal movement about the pivot axis of the first means, including fork means having axes which intersect and are coplanar with the axis of rotation of the front wheel, the pivot axis of the first means being forward of, parallel to, and not intersecting the plane including the axes of the fork means and the axis of rotation of the front wheel, so that when the center of gravity of the vehicle moves to one side of the longitudinal plane, the front wheel tends to pivot toward the direction of movement of the center of gravity, about the pivot axis of the first means.

12. The vehicle of claim 11 wherein the mounting means further comprises:

means for positioning the pivot axis of the first means within the longitudinal plane; and down tube means to which the positioning means is fixedly connected, the down tube means having parallel axes which are normally coaxial with the axes of the fork means.

13. The vehicle of claim 12 wherein the down tube means and fork means axes intersects the surface upon which the front wheel rides, when the vehicle is generally upright, at an angle of approximately 20° to 25° relative to vertical.

14. The vehicle of claim 12 wherein the down tube axes intersect the surface upon which the front wheel is supported, when the vehicle is generally upright, at an angle of approximately 22° relative to vertical.

15. A bicycle comprising front and rear wheels attached to a frame, the front wheel being so mounted as to be steerable to control the direction of movement of the vehicle, a generally longitudinal plane passing centrally through the frame such that all weight on the bicycle is symmetrically arranged to either side of the longitudinal plane when the front wheel is generally aligned with the frame;

a steering weight mounted on the bicycle comprising an arm, means pivotally mounting said arm to said frame and a weight means mounted at one end of the arm and otherwise unattached to the frame said weight means being located above the means pivotally mounting said arm when the bicycle is upright;

means for controlling the position of the arm relative to the longitudinal plane between a position in which the mass of the weight means is symmetrical relative to the longitudinal plane and a position in which the mass is asymmetrical relative thereto; and means for turning the front wheel of the bicycle toward the direction, relative to the longitudinal plane, in which the steering weight means is positioned in an amount determined by the amount of asymmetry of the mass of the steering weight, including:

means for attaching the front wheel to the frame including fork means attached to and fixing the axis of rotation of the front wheel and pivotally attached to the frame; and means forming a pivot axis for attaching the fork means to the frame, said pivot axis being forward of and parallel to the fork means.

16. The bicycle apparatus of claim 15 wherein the means forming a pivot axis includes means for maintaining the axes of the fork means at an angle of about 20° to 25° relative to vertical when the front wheel is aligned with the frame and the bicycle is upright.

17. The bicycle of claim 15 wherein the means forming a pivot axis includes steering crown means for maintaining the axes of the fork means at an angle of about 22° relative to a vertical plane when the front wheel is aligned with the frame and the bicycle is upright.

18. The bicycle of claim 16 or 17 wherein the means for attaching the front wheel to the frame includes means for normally maintaining the front wheel axis of rotation in a first position relative to the pivot axis, while permitting the axis of rotation to move to a second position further from the pivot axis temporarily, if the front wheel strikes an abutment.

19. The bicycle of claim 15, 16, or 17 including means, releasably fastenable to the bicycle such that the total mass thereof is symmetrically arranged relative to the longitudinal plane, for inhibiting the bicycle from falling over when it comes to a stop.

20. The bicycle of claim 19 wherein the inhibiting means includes a pair of crash bars; and means for fixing the crash bars in various selected vertically located positions relative to the frame to facilitate skill development of the bicycle operator.

21. The bicycle of claim 15 wherein the means for controlling the steering weight position includes means for preventing damage to the controlling means when the steering weight is moved by an external force.

22. A two-wheeled, radio controlled vehicle comprising:

a frame having a longitudinal plane extending therethrough;

a rear wheel rotatably mounted near one end of the frame;

a motor mounted on the frame;

drive means connecting the rear wheel to the motor for moving the vehicle;

a receiver mounted on the frame;

servo motor means mounted on the frame and operatively connected to the receiver;

means on the frame for powering the servo motor to selectively create a rotational force about an output shaft of the servo motor;

steering weight means fixed to the servo motor output shaft for pivotal movement about the axis of the shaft, the steering weight means being located above said shaft when the vehicle is upright and being unattached to the vehicle and free-swinging except for its connection to the servo motor ouput shaft;

a front wheel rotatably attached near the other end of the frame;

means for turning the front wheel about a pivot axis to steer the vehicle;

the front and rear wheels, motor, drive means, receiver, servo motor, power means, and turning means being so arranged as to provide the total mass thereof to be arranged symmetrically on either side of the longitudinal plane;

means, including the receiver, for actuating the servo motor means to position the steering weight such that the mass of the steering weight may be moved to either side of the longitudinal plane as well as arranged symmetrically relative thereto.

23. The vehicle of claim 22 wherein the turning means includes an axis which, relative to vertical at an angle of about 20° to 25°, when all of the mass on the vehicle is arranged symmetrically relative to the longitudinal plane and the vehicle is upright.

24. The vehicle of claim 22 wherein the turning means includes an axis which, relative to vertical, intersects the surface supporting the vehicle front wheel at an angle of about 22° when all of the mass on the vehicle is arranged symmetrically relative to the longitudinal plane and the vehicle is upright.

25. A two-wheeled, radio-controlled vehicle comprising:

a frame;

a rear wheel rotatably mounted near one end of the frame;

a motor mounted on the frame in a position to provide a low center of gravity for the vehicle;

drive means connecting the rear wheel to the motor for moving the vehicle;

servo motor means mounted on the frame in a position to provide a low center of gravity for the vehicle;

steering weight means operatively connected to the servo motor means for remote control thereof upon receipt of a predetermined signal, said steering weight means including an arm operatively connected near one end thereof to the servo motor means and an otherwise free-swinging weight attached to the other end of the arm, the weight and the arm comprising a turning mass which is movable by the servo motor means from the first position, in which the mass is symmetrically arranged relative to the longitudinal extent of the frame, such that the center of gravity of the vehicle is normally situated on the longitudinal extent of the frame, toward a pair of second positions, one on either side of the frame, such that the center of gravity of the vehicle may thereby be shifted from the longitudinal extent of the frame to either side thereof;

pivot means having a pivot axis and mounted near the other end of the frame;

a steering crown fixedly attached to the pivot means for pivotal movement about the pivot axis and steering crown and including down tube means means suspended from the crown and having down tube means axes;

fork means movably fastened to the down tube means and having axes which are normally coaxial with the down tube means axes;

a front wheel rotatably mounted on the fork means for rotation on an axle having a rotation axis which normally intersects the down tube means axes and fork means axes, said pivot axis being parallel to and forward of said down tube means axes when the vehicle is upright and the front wheel is in longitudinal alignment with the frame, such that shifting of the center of gravity to one side of the frame by movement of the steering weight means mass causes the steering crown to turn the front wheel about the pivot axis in the direction of the shift of the center of gravity to counteract the tendency of the vehicle to fall over on its side in the direction of the shift of the center of gravity; and means resiliently mounting the down tube means to the fork means for resiliently biasing the fork means axes and down tube means axes into the normally coaxial relationship thereof, while allowing limited relative resilient movement between the fork means and the down tube means so that the axes of the fork means and the down tube means may be temporarily moved out of the coaxial relationship when the front wheel contacts an obstruction during movement of the vehicle.

26. The method of controlling a two-wheeled vehicle having a radio controlled free-swinging balancing mass pivotally connected thereto, said pivotal connection being below said mass when the vehicle is upright, said vehicle having a front wheel pivot which is forward of the wheel fork comprising the steps of:

actuating a remote transmitter to emit a radio signal therefrom;

receiving the emitted signal in a receiver mounted on the vehicle;

actuating the free-swinging balancing mass to one side of the central longitudinal plane of the vehicle in an amount determined by the signal received by the receiver to thereby turn the front wheel of the vehicle toward the direction into which the free-swinging balancing mass has been actuated relative to the longitudinal plane of the vehicle;

said step of actuating the balancing weight including:

driving a servo which is in electrical communication with the signal receiving means and thereby pivotably moving the balancing mass about a relatively low point on the vehicle to generate a torque about a relatively low center of gravity on the vehicle; and, thereafter actuating the balancing mass to a position in which it is symmetrically arranged relative to the central longitudinal plane of the vehicle to thereby turn the front wheel back to a position in which it is symmetrically arranged relative to the longitudinal plane of the vehicle.

* * * * *